US008336884B1

(12) United States Patent
Pierce

(10) Patent No.: US 8,336,884 B1
(45) Date of Patent: Dec. 25, 2012

(54) WATER DOUSING GAME APPARATUS

(76) Inventor: Franklin K. Pierce, Ormond Beach, FL (US)

( * ) Notice: Subject to any disclaimer, the term of this patent is extended or adjusted under 35 U.S.C. 154(b) by 0 days.

(21) Appl. No.: 13/565,873

(22) Filed: Aug. 3, 2012

(51) Int. Cl.
*F41J 5/14* (2006.01)
*A63B 63/00* (2006.01)

(52) U.S. Cl. ..... 273/384; 273/385

(58) Field of Classification Search ..... 273/383–387; 4/602

See application file for complete search history.

(56) References Cited

U.S. PATENT DOCUMENTS 1,191,605 A * 7/1916 Mertz ..... 124/16
1,593,267 A * 7/1926 Myre ..... 273/375
1,671,000 A * 5/1928 Weinstein ..... 273/387
4,093,228 A * 6/1978 Pierce ..... 273/384
4,702,480 A * 10/1987 Popeski et al. ..... 273/384
4,943,064 A * 7/1990 Smith, Jr. ..... 273/384
D334,044 S * 3/1993 Lopatin ..... D21/811
5,482,292 A * 1/1996 Stone ..... 273/384
5,634,642 A * 6/1997 Grandolfo ..... 473/423
5,839,981 A * 11/1998 Rudell et al. ..... 473/480
5,848,793 A * 12/1998 Celis ..... 273/384
5,947,476 A * 9/1999 Rousay ..... 273/384
6,102,404 A * 8/2000 Barker ..... 273/385
6,264,201 B1 * 7/2001 Holsten et al. ..... 273/384
6,296,252 B1 * 10/2001 Hubka ..... 273/384
7,316,400 B1 * 1/2008 Holsten et al. ..... 273/445

* cited by examiner

*Primary Examiner* — Mark Graham
(74) *Attorney, Agent, or Firm* — Montgomery Patent & Design LLC; Robert C. Montgomery; Joseph Yaksich

(57) ABSTRACT

A water dousing target game in which water is dumped upon a player when a target is hit with a projective includes a support stand, a water reservoir, and a drop mechanism having a trip rod and a paddle mechanism with a target. The stand assembly is height-adjustable having a plurality of stabilizing legs. The water reservoir is located at a top end of the support stand. The drop mechanism includes a bottom panel hingedly covering an open bottom of the reservoir having an attached trip rod releasably supported by the paddle mechanism. The paddle mechanism includes an arm rotatably connected to the support stand and the target having a flat enlarged end. When the target is struck with a projectile, the paddle arm rotates and releases the trip rod support, causing the bottom panel of the reservoir to hinge open and drop the contents on another person.

20 Claims, 6 Drawing Sheets

WATER DOUSING GAME APPARATUS

RELATED APPLICATIONS

Not Applicable.

FIELD OF THE INVENTION

The present invention relates generally to water games, and in particular, to a water dousing game in which a thrown projectile is used to douse another person with water.

BACKGROUND OF THE INVENTION

The toy industry is a multibillion dollar, global industry that is continually growing as more and more products are developed and introduced to the buying public. The toy industry is somewhat unique in the sense that it is highly susceptible to trendy products or fads. This is due most likely to the fact that when a product achieves a certain level of popularity, demand can skyrocket in a domino effect manner. This is not necessarily to say that these products require revolutionary or innovative designs. On the contrary, items such as CABBAGE PATCH™ and TICKLE ME ELMO™ are otherwise conventional toys that have achieved enormous, even record, popularity based primarily on their fun factor. These same pressures apply to all areas of the entertainment industry including that of party games as well. One (1) particularly popular party game is that of the water games which are typically utilized for the purpose of entertaining users and consist basically of familiar structural configurations.

SUMMARY OF THE INVENTION

The inventor has recognized a lack in the art and observed that there is a need for a new water dousing game. The development of the present invention substantially departs from the conventional solutions and in doing so fulfills this need.

In accordance with features and aspects of certain embodiments, a water dousing game apparatus includes a generally vertical stand assembly having a lower post and an upper post connected to the lower post. A cylindrical reservoir is affixed to the upper post and configured to hold a dousing material. The reservoir has an open top and an open bottom. A bottom panel is hingedly attached to the upper post below the reservoir and is pivotable between a closed position, covering the reservoir open bottom, and an open position, uncovering the reservoir open bottom. A trip rod is provided having an upper end pivotably attached to a bottom surface of the bottom panel opposite the upper post and a lower end extending downwardly from the bottom panel. A paddle arm is hingedly attached to the upper post below the reservoir. A top surface of the paddle arm operatively supports the trip rod lower end for maintaining the bottom panel in the closed position. Upon pivoting of the paddle arm, the trip rod is unsupported and the bottom panel pivots downwardly into the open position to dump the dousing material. A paddle target is disposed at an end of the paddle arm opposite the upper post to be impacted by a projectile thrown by a game thrower.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
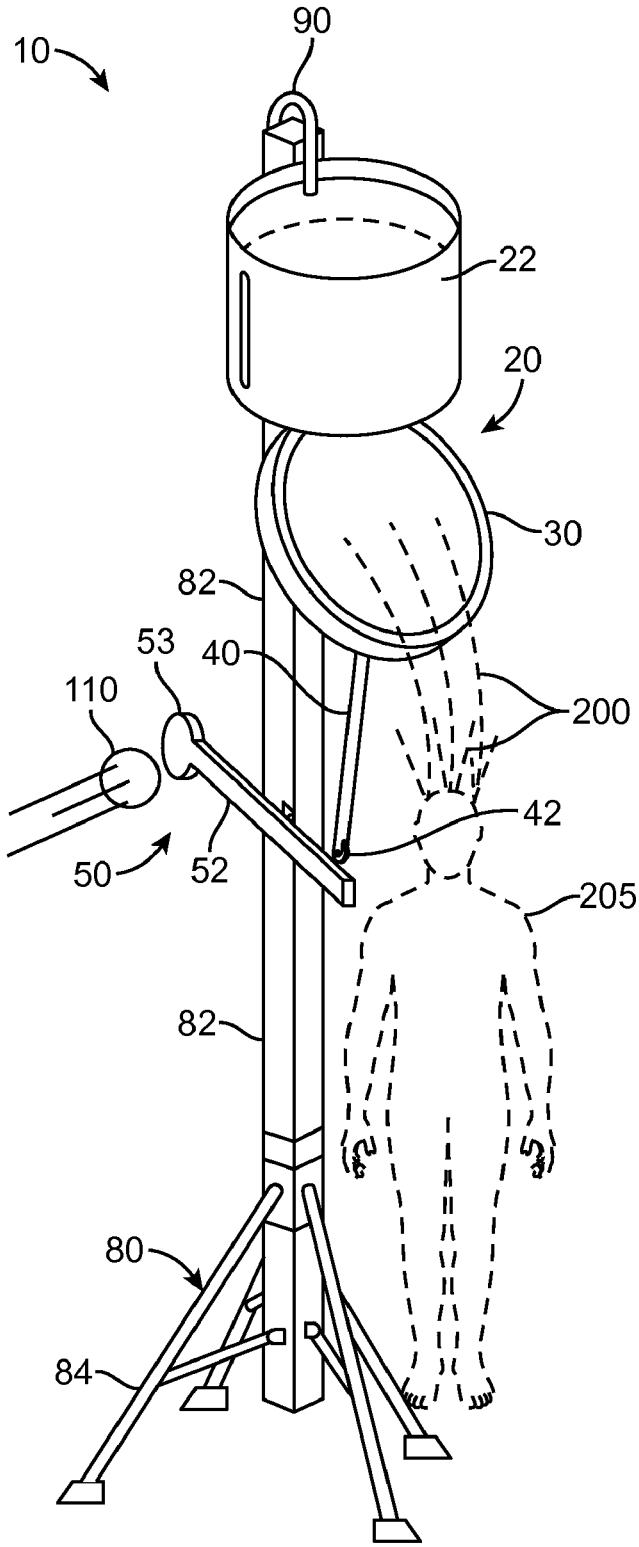
FIG. 1 is an environmental view of a water dousing game apparatus, depicted in an in-use state, according to the present invention.

10 water dousing game apparatus
20 reservoir assembly
22 cylinder
23 top opening
24 mounting bracket
25 bottom opening
26 liquid level window
28 graduation make
30 reservoir bottom panel
32 first hinge
34 O-ring gasket
40 trip rod
42 wheel
46 second hinge
50 paddle arm mechanism
52 paddle arm
53 paddle target
56 third hinge
80 stand assembly
82 upper post
83 lower post
84 leg
85 spring button
86 foot
87 sleeve
88 brace
90 spout
92 water supply hose
93 aperture
94 hose bracket
96 hose fitting
110 projectile
115 fastener
200 water
205 player

DETAILED DESCRIPTION OF THE PREFERRED EMBODIMENT

In accordance with the invention, the best mode is presented in terms of certain embodiments, herein depicted within FIGS. 1 through 5*b*. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 5*b*, depicting a water dousing game apparatus, identified generally by reference to an apparatus 10, where like reference numerals represent similar or like parts. Throughout this disclosure, the apparatus 10 may also be referred to as game, dousing game, dump game, or drop game. Alternate references of the apparatus 10 in this disclosure are not meant to be limiting in any way. In accordance with the teachings of the present disclosure, the apparatus 10 provides for a novelty target game in which water 200 or other similar materials such as snow, confetti, or the like, is dumped upon a player 205 when a paddle target 53 is hit with a projectile 110.

Referring to FIG. 1, the apparatus 10 includes a height-adjustable stand assembly 80 that is approximately three meters (3 m) (9 ft) tall which provides for use of the apparatus 10 by players 205 of various heights. The apparatus 10 also includes a water holding reservoir assembly 20 attached to an upper post 82 of the stand assembly 80 and capable of holding approximately eleven to twenty liters (11-20 L) (3-5 gallons).

In use, the reservoir assembly 20 is filled with water 200 and a player 205 is positioned directly below the reservoir assembly 20. The water 200 within the reservoir assembly 20 is doused or dumped upon the player 205 by a mechanical release of a hinged reservoir bottom panel 30 which is actuated in response to movement of a paddle arm mechanism 50 when struck by the projectile 110. In alternate methods of use, the reservoir assembly 20 can also be filled with snow, confetti, prizes, or other suitable dousing material to provide a similar effect based upon a user's preference. It can be appreciated that the reference to water 200 throughout the disclosure as the dousing material is not meant to be limiting in any way. During use, it is envisioned that a player 205 stands underneath the reservoir assembly 20 while a throwing player 205 takes three (3) turns trying to hit the paddle target 53 with the projectile 110 from a preselected distance.

Figure 2:
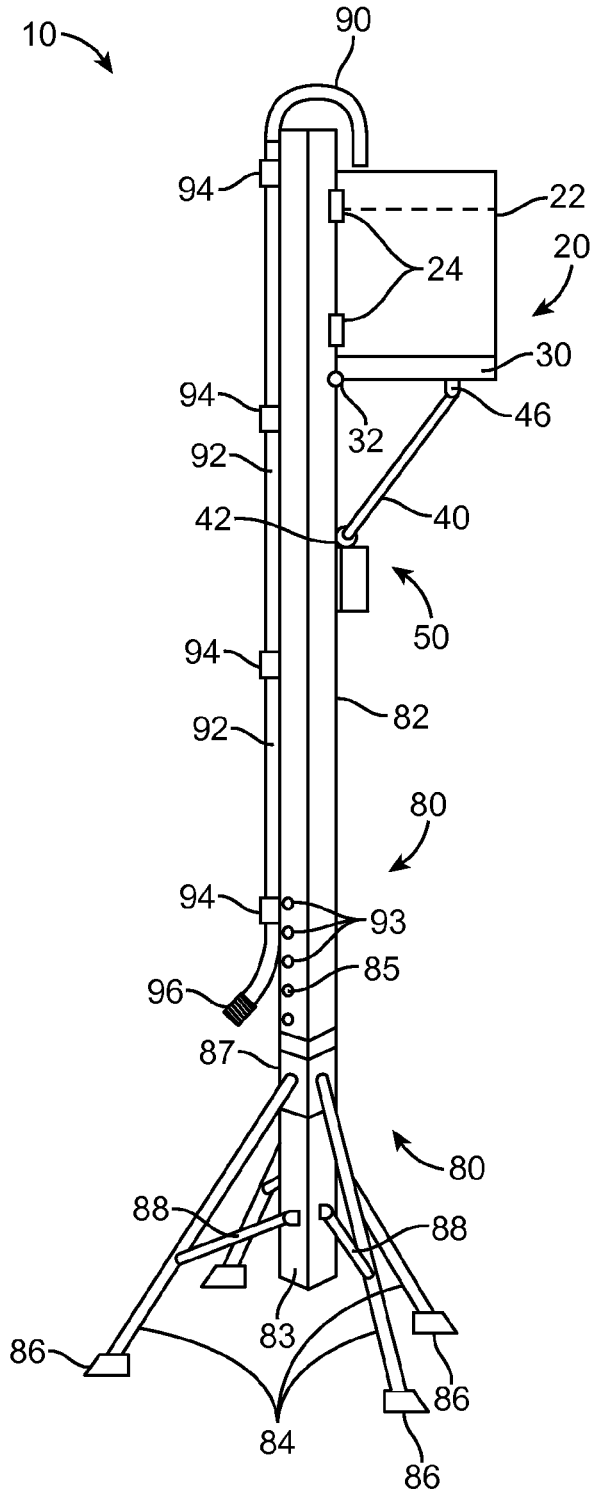
FIG. 2 is a side view of the water dousing game apparatus.
Figure 3:
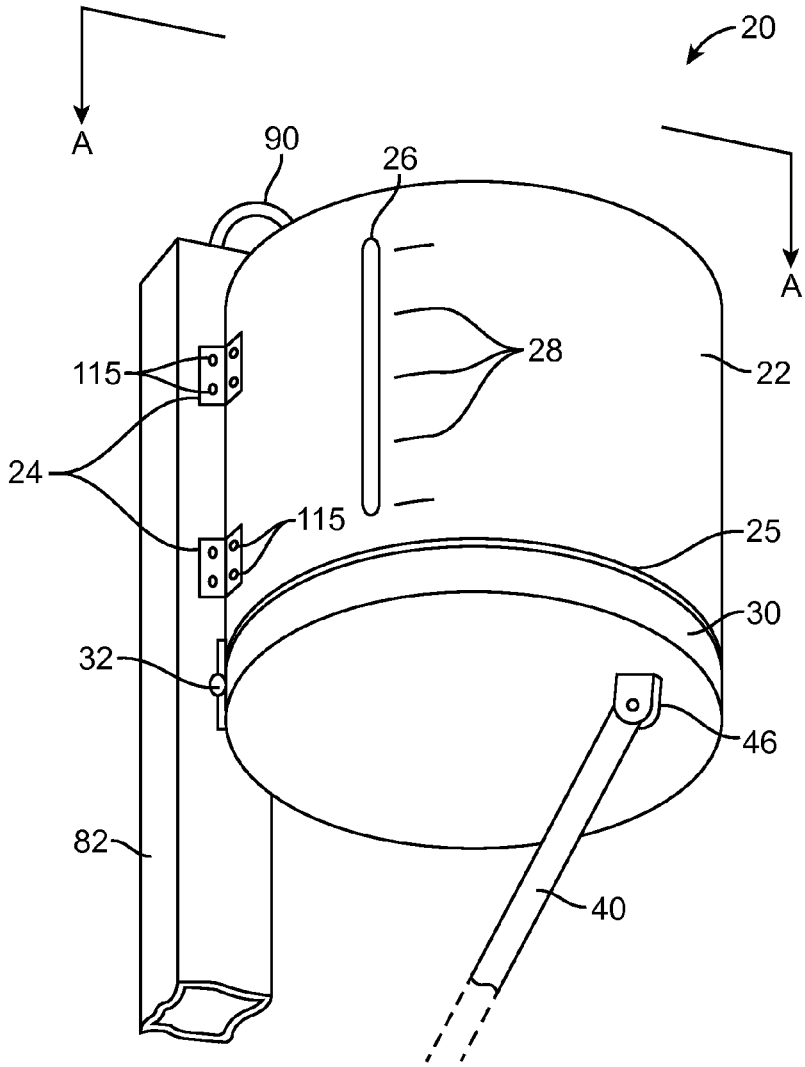
FIG. 3 is an upward-looking perspective view of a reservoir assembly of the water dousing game apparatus according to the present invention.

Referring now to FIGS. 2 and 3, the reservoir assembly 20 is a cylinder 22, preferably formed of plastic or metal, rigidly attached along a side surface to the upper post 82 at an elevated position by at least two (2) "L"-shaped mounting brackets 24 and corresponding fasteners 115. The cylinder 22 includes a top opening 23 which provides a water filling orifice from a spout 90 and a bottom opening 25. A bottom panel 30 is hingedly attached to a bottom edge of the cylinder 22 and provides a releasably sealed containment of the water 200 along the bottom opening 25. In use, the bottom panel 30 is released and pivots downwardly about a first hinge 32 to dump the water 200 contained within the cylinder 22.

A supply of water 200 is dispensed into the reservoir assembly 20 via the spout 90. The spout 90 is supplied by a water supply hose 92. The water supply hose 92 generally includes a threaded male hose fitting 96 at a lower end. The water supply hose 92 is routed upwardly along a rear surface of an upper post 82 and terminates at the integral gooseneck-shaped spout 90. The spout 90 directs the water 200 downwardly into the top opening 23 of the cylinder 22. The water supply hose 92 is attached to the upper post 82 using a plurality of "U"-shaped hose brackets 94 and corresponding fasteners 115. The flow of water 200 through the water supply hose 92 is established by connecting a supply hose, such as a standard garden hose connected to a water supply, to the male hose fitting 96 and remotely initiating a flow of water 200.

The stand assembly 80 includes the upper post 82, a lower post 83, and four (4) foldable legs 84. The upper and lower posts 82, 83 are rigid, hollow rectangular tubing approximately seven centimeters (7 cm) (3 in) square in cross section and preferably made of steel, aluminum, composite plastic, or the like. being. The overall height of the apparatus 10 is adjustable by selectively inserting a top end portion of the lower post 83 into an open bottom end portion of the upper post 82. The lower post 83 includes a protruding spring button 85 or similar locking mechanism. Correspondingly a front side the upper post 82 includes a plurality of matching apertures 93 arranged linear along a central longitudinal axis. The spring button 85 insertably engages an aligned aperture 93 to secure the upper post 82 at a desired height relative to the lower post 83. It is envisioned that the apertures 93 are sufficiently spaced apart to allow selective adjustability over a range of sixty to ninety centimeters (60-90 cm) (2-3 feet). When not in use, the upper post 82 and lower post 83 can be completely separated for compact and convenient storage or transportation.

The folding legs 84 are hingedly attached to a sleeve 87 and are supported by respective pivotably attached braces 88 at a lower end of the lower post 83. The sleeve 87 slidingly encompasses the lower post 83 allowing a user to raise or lower the sleeve 87 and correspondingly collapse or deploy the legs 84. This feature allows a user to collapse the legs 84 linearly against the lower post 83 for compact storage. The braces 88 act as a mechanical limitation when deploying the legs 84 outwardly prior to use. The legs 84 each comprise a rubber or plastic foot 86 inserted upon respective bottom ends to provide high-friction contact upon a subjacent surface for stability, while also preventing damage to the floor surface.

Figure 4:
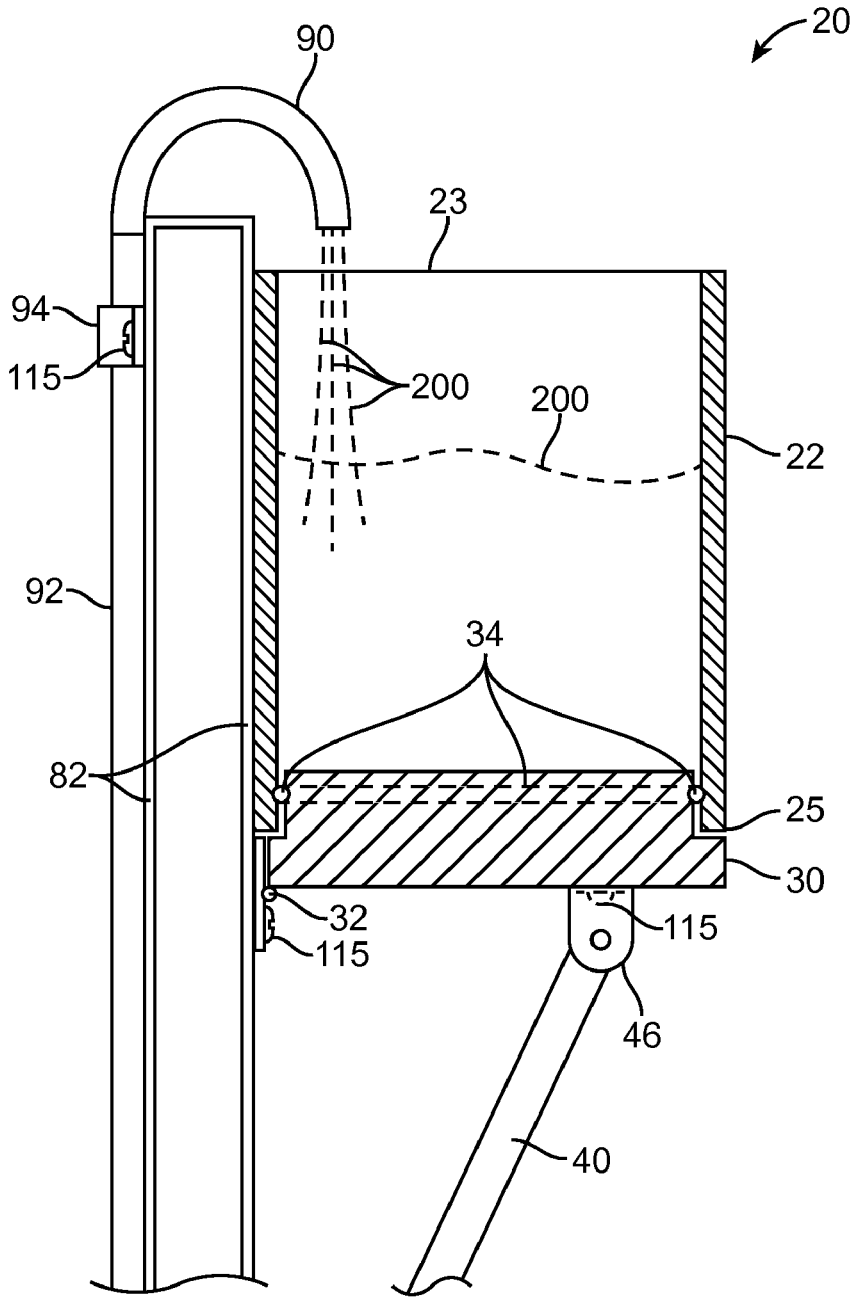
FIG. 4 is a section view of the reservoir assembly taken along section line A-A of FIG. 3 according to the present invention.

Referring now to FIGS. 3 and 4, the reservoir assembly 20 includes a transparent liquid level window 26 along a side surface which provides a visual indication of water 200 within the cylinder 22. The liquid level window 26 includes a vertical linear window incorporated into a wall portion of the cylinder 22 having a plurality of corresponding graduation lines 28. The water 200 is retained within the cylinder 22 by the pivotably attachable reservoir bottom panel 30 which seals the bottom opening 25 of the cylinder 22 in a closed position. The reservoir bottom panel 30 is a round member suitably sized to snugly fit into the bottom opening 25 when in the closed position. The reservoir bottom panel 30 also includes a large rubber O-ring gasket 34 disposed around a perimeter surface which seals the reservoir bottom panel 30 and an inner surface of the lower end of the cylinder 22. The reservoir bottom panel 30 is hingedly attached to the upper post 82 by a first hinge 32.

In the closed position, the bottom panel 30 is in a generally vertical position in contact within the bottom opening 25 of the cylinder 22. In the open position, the bottom panel 30 is in a generally vertical position following a downward pivoting motion to dump the contained water 200. The reservoir bottom panel 30 is supported in the closed position and held within the bottom opening 25 by downwardly extending trip rod 40. i.e., the "ready" state. The trip rod 40 is hingedly attached to a bottom surface of the bottom panel 30 at a position opposite the first hinge 32 by a "U"-shaped second hinge 46 affixed using corresponding fasteners 115. The trip rod 40 is a round rod which is supported at a bottom end by the paddle arm mechanism 50. During play, the "triggering" of the paddle arm mechanism 50 causes the trip rod 40 and reservoir bottom panel 30 to be lowered, thereby dumping the water 200 onto the player 205 (see FIG. 1).

Figure 5A:
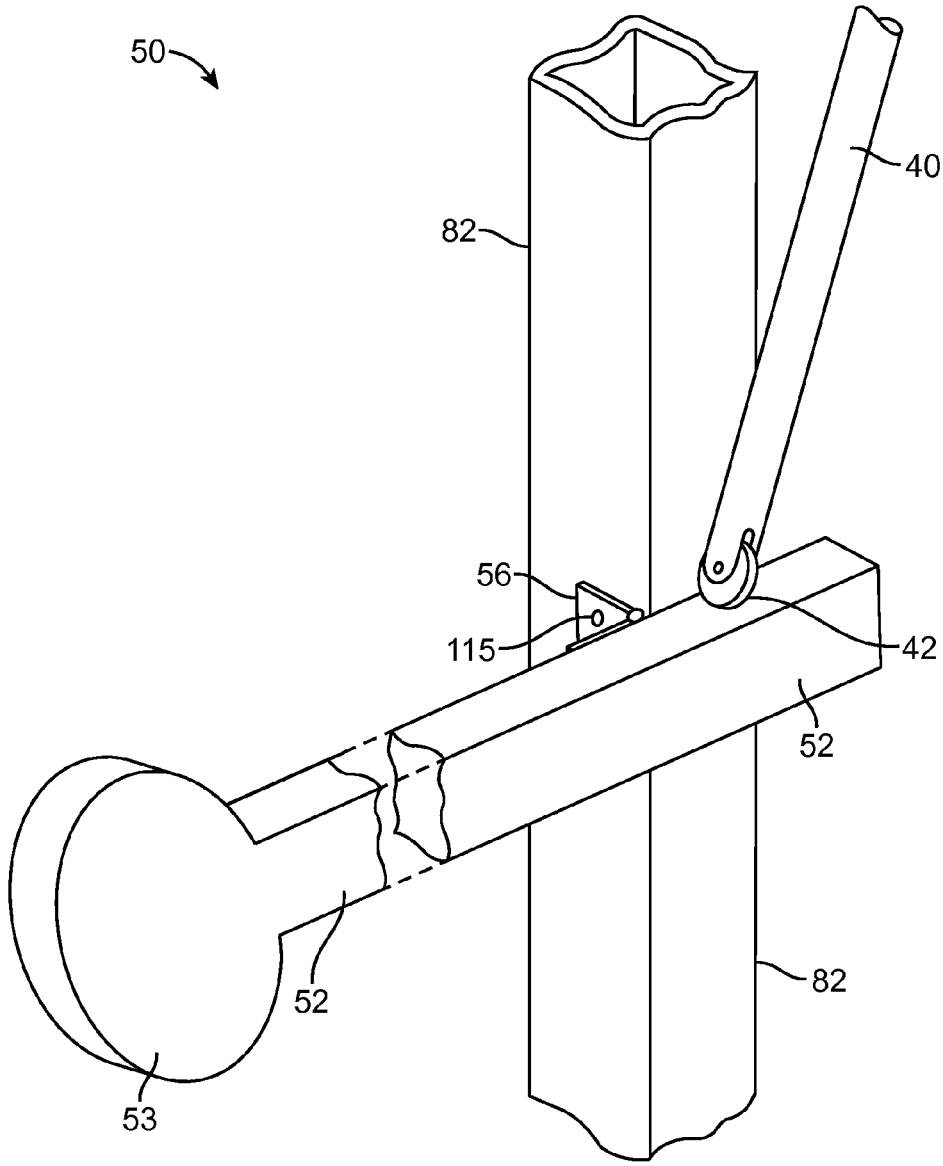
FIG. 5*a* is a close-up view of a paddle arm mechanism of the water dousing game apparatus, depicted in a "ready" state, according to the present invention; and, FIG. 5*b* is a close-up view of the paddle arm mechanism, depicted in a "triggered" state, according to the present invention.
Figure 5B:
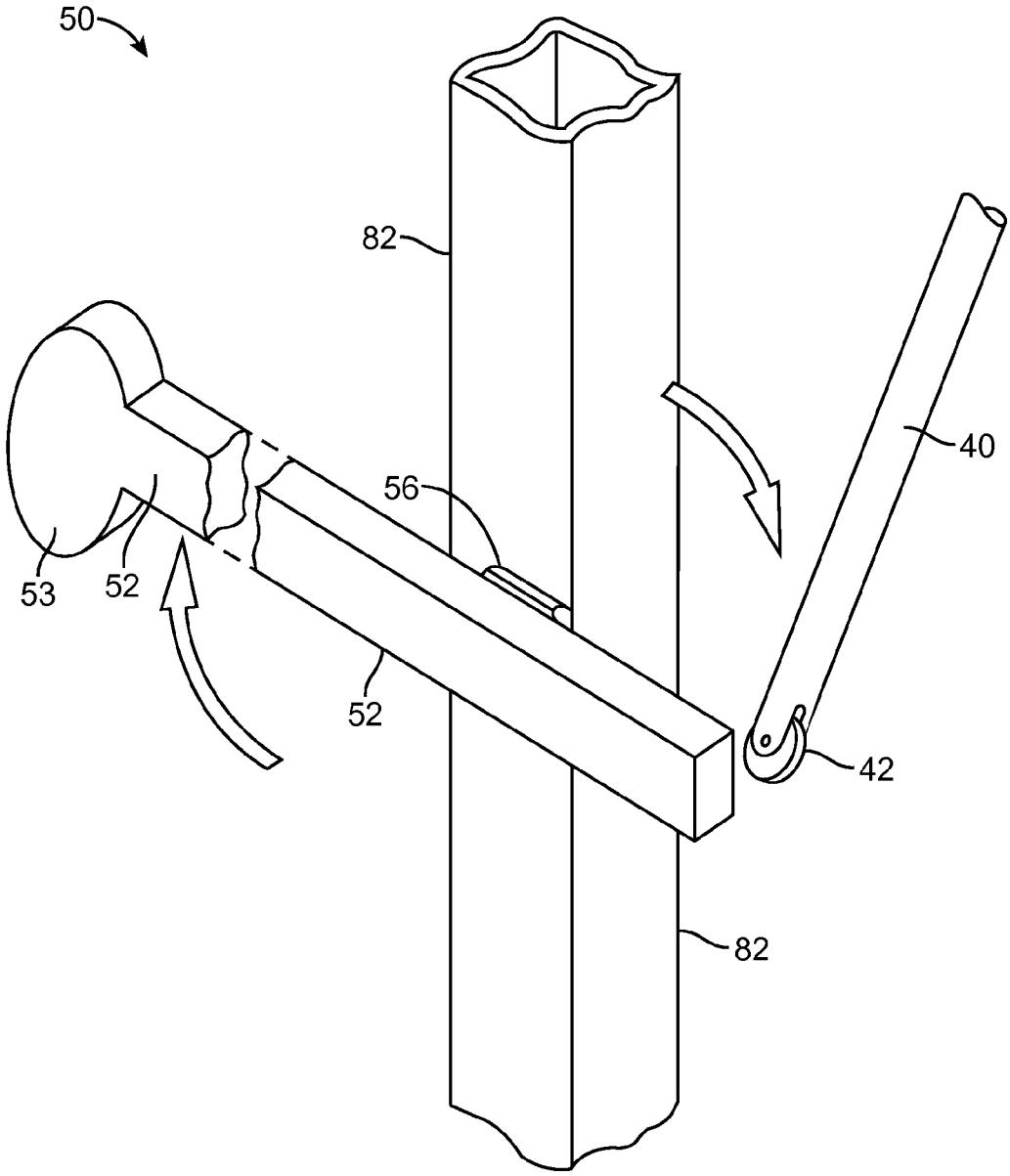

Referring next to FIGS. 5*a* and 5*b*, the paddle arm mechanism 50 provides a mechanical means to release the trip rod 40 and lower the reservoir bottom panel 30 downwardly to the open position, i.e., the "triggered" state, to dump the water 200. The paddle arm mechanism 50 includes a paddle arm 52, a paddle target 53, and a third hinge 56.

The paddle arm 52 is a horizontally protruding appendage having the integral circular paddle target 53 disposed at a distal end opposite the stand assembly 80. The paddle arm 52 is hingedly attached to the upper post 82 by the third hinge 56, thereby allowing the paddle arm 52 to be motioned in an arcuate manner along a horizontal plane when the paddle target 53 is contacted by the projectile 110. It can be appreciated that the apparatus 10 can be configured with the paddle arm 52 extending either in a right-hand or left-hand orientation relative to the upper post 82 and is not meant to be limiting in any manner. A horizontal top surface of the paddle arm 52 supports the lower end of the trip rod 40 when in the "ready" state. The lower end of the trip rod 40 also includes an integral wheel 42 which rests upon the top surface of the paddle arm 52.

When in the "ready" state, as illustrated in FIG. 5*a*, the wheel 42 upon the top surface of the paddle arm 52 to support the bottom panel 30 and retain it in the closed position within the cylinder 22. The paddle arm mechanism 50 is "triggered" when the paddle target 53 is contacted by the projectile 110, as seen in FIG. 5*b*, thus causing the paddle target 53 and paddle arm 52 to pivot rearwardly about the third hinge 56, thereby causing the wheel 42 to roll off of the paddle arm 52. Once the wheel 42 is no longer supported by the paddle arm 52, the trip rod 40 and reservoir bottom panel 30 are compelled to fall downwardly to dump the water 200 upon the player 205 positioned below the reservoir assembly 20.

It can be appreciated by one skilled in the art that other styles and configurations of the present invention can be easily incorporated into the teachings of the present disclosure and only certain particular configurations have been shown and described for purposes of clarity and disclosure and not by way of limitation of scope.

In accordance with the principles of the present invention, the apparatus 10 can be installed and utilized by the user in a simple and effortless manner with little or no training in general accordance with FIG. 1 through FIG. 5*b*. It can be appreciated that the steps required to utilize the apparatus 10, as described, can performed in alternative order and as such should not be viewed as a limiting factor.

The method of installing the apparatus 10 can be achieved by performing the following steps: procuring the apparatus 10; setting up the lower post 83 and legs 84 of the stand assembly 80; deploying the legs 84 outwardly from the lower post 83 by sliding the sleeve 87 downwardly until the braces 88 are fully extended and the legs 84 are fully deployed outwardly; placing the lower post 83 and legs 84 upon a level surface; installing the remaining portions of the apparatus 10 onto the lower post 83 by inserting the lower post 83 within the upper post 82; adjusting a height of the upper post 82 to position the reservoir assembly 20 at a desired height; utilizing the spring button 85 and corresponding apertures 93 to secure the position of the upper post 82; pivoting the paddle arm 52 to a forward "ready" position; inserting the reservoir bottom panel 30 into the bottom opening 25 of the cylinder 22; securing the reservoir bottom panel 30 by positioning the wheel 42 of the trip rod 40 upon the paddle arm 52 of the paddle arm mechanism 50; connecting an existing water supply to the hose fitting 96 of the water supply hose 92; initiating a flow of water to fill the cylinder 22; filling the cylinder 22 with water 200 while observing a level of water 200 using the liquid level window 26 and corresponding graduation marks 28; and, stopping the flow of water 200 remotely upon obtaining a desired water level 200 within the cylinder 22. The apparatus 10 is now in a "ready" state for playing the water drop game.

The method of utilizing the apparatus 10 to play the water drop game can be achieved by performing the following steps: positioning a player 205 upon a floor or ground surface directly below the reservoir assembly 20; allowing a throwing player to throw at least one (1) projectile 110 at the paddle target 53; striking the paddle target 53 with a projectile 110 causing the paddle target 53 and paddle arm 52 to pivot horizontally and rearwardly about the third hinge 56; causing the wheel 42 to roll off of the paddle arm 52; causing the trip rod 40 to free-fall downwardly; causing the reservoir bottom panel 30 to pivot downwardly about the first hinge 32; causing the water 200 within the cylinder 22 to be dumped upon the player 205; continuing to play the water drop game apparatus 10 by repeating the water filling steps as previously described; and, continuing to "trigger" the apparatus 10 as described above.

The method of storing the apparatus 10 can be accomplished by performing the following steps: disconnecting the hose fitting 96 from the water supply; emptying the reservoir assembly 20 of any water 200 by pivoting the reservoir bottom panel 30 downwardly; depressing the spring button 85; lifting the upper post 82 off of the lower post 83; lifting the lower post 83 off of the subjacent surface; sliding the sleeve 87 upward to collapse the legs 84 against the lower post 83; and, storing the apparatus 10 until once again needed for play.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A water dousing game apparatus comprising:

a generally vertical stand assembly;

a reservoir affixed to an upper end of said stand assembly and configured to hold a dousing material;

a bottom panel hingedly attached to said stand assembly below said reservoir and pivotable between a closed and an open position;

a trip rod extending downwardly from said bottom panel; and, a paddle arm mechanism hingedly attached to said stand assembly below said reservoir, said paddle arm mechanism operatively supporting said trip rod for maintaining said bottom panel in said closed position, whereby upon pivoting of said paddle arm mechanism said trip rod is unsupported and said bottom panel pivots downwardly into said open position to dump said dousing material.

2. The apparatus of claim 1, wherein said dousing material is water, said apparatus further comprising:

a spout affixed to said stand assembly above said reservoir; and, a supply hose routed along said stand assembly, said supply hose having a first end fluidly connected to said spout and a second end configured to fluidly connect to a water supply.

3. The apparatus of claim 1, wherein said stand assembly is height adjustable.

4. The apparatus of claim 1, wherein said reservoir assembly comprises a cylindrical tank having an open top and an open bottom, said bottom panel being hingedly attached to said stand assembly about a lower perimeter edge of said tank open bottom.

5. The apparatus of claim 4, wherein said cylindrical tank further comprises a transparent liquid level window disposed in a sidewall of said cylindrical tank, said liquid level window comprising a plurality of spaced apart graduation marks configured to visually indicate an amount of said dousing material.

6. The apparatus of claim 1, wherein said stand assembly comprises a plurality of hingedly attached legs deployable between a retracted and an extended position to support said stand assembly on a support surface.

7. The apparatus of claim 1, wherein said trip rod is pivotably attached to a bottom surface of said bottom panel opposite said stand assembly.

8. The apparatus of claim 1, wherein said trip rod comprises an upper end pivotably attached to a bottom surface and a lower end contactingly support by said paddle arm mechanism.

9. The apparatus of claim 8, wherein said trip rod lower end comprises a rotatably attached wheel.

10. The apparatus of claim 1, wherein said paddle arm mechanism comprises:

a paddle arm hingedly connected to said stand assembly; and, a paddle target disposed at an end of said paddle arm opposite said stand assembly;

wherein said trip rod rests upon a top surface of said paddle arm.

11. A water dousing game apparatus comprising:

a generally vertical stand assembly comprising a lower post and an upper post connected to said lower post;

a cylindrical reservoir affixed to said upper post and configured to hold a dousing material, said reservoir comprising an open top and an open bottom;

a bottom panel hingedly attached to said upper post below said reservoir and pivotable between a closed position covering said reservoir open bottom and an open position uncovering said reservoir open bottom;

a trip rod comprising an upper end pivotably attached to a bottom surface of said bottom panel opposite said upper post and a lower end extending downwardly from said bottom panel; and, a paddle arm hingedly attached to said upper post below said reservoir, a top surface of said paddle arm operatively supporting said trip rod lower end for maintaining said bottom panel in said closed position, whereby upon pivoting of said paddle arm said trip rod is unsupported and said bottom panel pivots downwardly into said open position to dump said dousing material; and, a paddle target disposed at an end of said paddle arm opposite said upper post.

12. The apparatus of claim 11, wherein said trip rod lower end comprises a rotatably attached wheel.

13. The apparatus of claim 12, wherein said lower post comprises a plurality of hingedly attached legs deployable between a retracted and an extended position to support said stand assembly on a support surface.

14. The apparatus of claim 13, wherein said lower post further comprises:

a slidably attached sleeve, each of said legs comprising an upper end pivotably attached to said sleeve and a lower end for contact with said support surface; and, a plurality of braces, each said brace comprising an inner end pivotably attached to said lower post and an outer end pivotably attached to a respective leg.

15. The apparatus of claim 14, wherein said upper post comprises a hollow lower end suitably sized to receive an upper end of said lower post such that said upper post is height adjustable relative to said lower post, said upper post is secured at a selected position by a retaining mechanism.

16. The apparatus of claim 15, wherein said retaining mechanism comprises:

an outwardly protruding spring button disposed at said lower post upper end; and, a plurality of spaced apart apertures disposed longitudinally along said upper post lower end;

wherein said spring button matingly engages a selected one of said plurality of apertures to secure said upper post relative to said lower post.

17. The apparatus of claim 16, wherein said dousing material is water, said apparatus further comprising:

a spout affixed to said stand assembly above said reservoir; and, a supply hose routed along said stand assembly, said supply hose having a first end fluidly connected to said spout and a second end configured to fluidly connect to a water supply.

18. The apparatus of claim 17, wherein said reservoir further comprises a transparent liquid level window disposed in a sidewall of said reservoir, said liquid level window comprising a plurality of spaced apart graduation marks configured to visually indicate an amount of said water.

19. The apparatus of claim 18, wherein each of said leg lower ends further comprises a rubber foot.

20. The apparatus of claim 19, wherein said bottom panel comprises a rubber O-ring gasket disposed around a perimeter edge to contactingly seal said bottom panel perimeter edge and an interior perimeter of said reservoir open bottom.

* * * * *